US009057548B2

(12) United States Patent
Liu

(10) Patent No.: US 9,057,548 B2
(45) Date of Patent: Jun. 16, 2015

(54) RECEIVER WITH FLOW METERING DEVICE

(75) Inventor: PeiJun Liu, Shanghai (CN)

(73) Assignee: CARRIER CORPORATION, Farmington, CT (US)

( * ) Notice: Subject to any disclaimer, the term of this patent is extended or adjusted under 35 U.S.C. 154(b) by 460 days.

(21) Appl. No.: 13/498,602

(22) PCT Filed: Oct. 14, 2009

(86) PCT No.: PCT/CN2009/001139

§ 371 (c)(1), (2), (4) Date: Mar. 28, 2012

(87) PCT Pub. No.: WO2011/044711

PCT Pub. Date: Apr. 21, 2011

(65) Prior Publication Data

US 2012/0204583 A1 Aug. 16, 2012

(51) Int. Cl.
*F25B 39/04* (2006.01)
*F25B 43/00* (2006.01)

(52) U.S. Cl.
CPC ..... *F25B 43/006* (2013.01); *F25B 2400/16* (2013.01); *F25B 2700/13* (2013.01)

(58) Field of Classification Search
USPC ..... 62/129, 509, 85, 93, 474, 511
See application file for complete search history.

(56) References Cited

U.S. PATENT DOCUMENTS

| | | | | |
|---|---|---|---|---|
| 2,768,513 | A * | 10/1956 | Morrison | 137/390 |
| 2,952,137 | A * | 9/1960 | Watkins | 62/174 |
| 3,866,433 | A | 2/1975 | Krug | |
| 4,180,988 | A | 1/1980 | Forte et al. | |
| 5,211,024 | A | 5/1993 | Manz et al. | |
| 5,471,850 | A | 12/1995 | Cowans | |
| 5,582,022 | A | 12/1996 | Heinrichs et al. | |
| 6,223,546 | B1 | 5/2001 | Chopko et al. | |
| 6,405,550 | B1 | 6/2002 | Reason et al. | |
| 6,543,242 | B2 | 4/2003 | Reason et al. | |
| 2009/0038322 | A1 | 2/2009 | Senf, Jr. et al. | |

FOREIGN PATENT DOCUMENTS

| | | |
|---|---|---|
| CN | 101201208 | 6/2008 |
| JP | 6011213 | 1/1994 |
| JP | 2002372345 | 12/2002 |

(Continued)

OTHER PUBLICATIONS

International Preliminary Report on Patentability mailed Apr. 26, 2012.

International Search Report and Written Opinion mailed Jul. 8, 2010.

*Primary Examiner* — Melvin Jones

(74) *Attorney, Agent, or Firm* — Cantor Colburn LLP

(57) ABSTRACT

A receiver (50) is provided for collecting a refrigerant flowing through a refrigerant flow circuit. The receiver housing (52) defines an enclosed volume (55) establishing a refrigerant collection reservoir, and has an inlet (54), a first outlet (56), and a second outlet (58). A refrigerant metering device (70) is disposed within the enclosed volume (55) in operative association with the second outlet (58) for controlling a flow of refrigerant discharging through the second outlet (58). The refrigerant metering device (70) may be a capillary tube metering device (72). The receiver (50) may also include a refrigerant filter/dryer (80) disposed within the enclosed volume (55).

13 Claims, 2 Drawing Sheets

(56) References Cited

FOREIGN PATENT DOCUMENTS

| | | |
|---|---|---|
| JP | 2004251584 | 9/2004 |
| JP | 2005214443 | 8/2005 |
| JP | 2005241169 A | 9/2005 |
| JP | 2006284135 | 10/2006 |

* cited by examiner

RECEIVER WITH FLOW METERING DEVICE

FIELD OF THE INVENTION

This invention relates generally to refrigerant receivers and, more particularly, to a refrigerant receiver including a flow metering device integrated therewith.

BACKGROUND OF THE INVENTION

Refrigerant vapor compression systems are well known in the art and commonly used for conditioning air to be supplied to a climate controlled comfort zone within a residence, office building, hospital, school, restaurant or other facility. Refrigerant vapor compression systems are also commonly used in refrigerating air supplied to display cases, merchandisers, freezer cabinets, cold rooms or other perishable/frozen product storage area in commercial establishments. Refrigerant vapor compression systems are also commonly used in transport refrigeration systems for refrigerating air supplied to a temperature controlled cargo space of a truck, trailer, container or the like for transporting perishable/frozen items by truck, rail, ship or intermodally.

Such refrigerant vapor compression systems include a compression device, a condenser heat exchanger, an evaporator expansion device, such as for example an electronic expansion valve or a thermostatic expansion valve, and an evaporator heat exchanger, arranged in series refrigerant flow relationship in a refrigerant flow circuit according to a refrigeration cycle. Many refrigerant vapor compression systems also include a receiver interdisposed in the refrigerant circuit, generally downstream with respect to refrigerant flow of the condenser and upstream with respect to refrigerant flow of the evaporator expansion device. The receiver functions to collect liquid refrigerant passing from the condenser heat exchanger and stores excess refrigerant. Conventional receivers typically include an inlet port through which refrigerant enters the receiver and a single outlet through which liquid refrigerant may pass out of the receiver. A discharge valve, for example a check valve, is typically mounted to the single receiver outlet to control refrigerant flow discharging from the receiver back into the refrigerant circuit upstream of the evaporator expansion valve. Additionally, many refrigerant vapor compression systems include a refrigerant filter-dryer interdisposed in the refrigerant flow circuit downstream with respect to refrigerant flow of the receiver and upstream with respect to refrigerant flow of the evaporator expansion valve. The filter-dryer functions to remove foreign matter and moisture from the refrigerant flowing therethrough. U.S. Pat. No. 7,571,622 combined in-line accumulator/filter dryer unit disposed between the two heat exchangers of a reversible refrigeration system.

In some refrigeration cycles, the refrigerant vapor compression system further includes a liquid injection line establishing refrigerant flow communication between the receiver and the suction side of the compression device. When a liquid injection line is present, a portion of the liquid refrigerant discharging from the single outlet of the receiver via the discharge valve passes through the liquid injection line to reenter the refrigerant flow circuit downstream with respect to refrigerant flow of the evaporator heat exchanger and upstream with respect to refrigerant flow of the suction inlet of the compression device, thereby bypassing the evaporator heat exchanger. A flow metering valve is disposed in the liquid injection line so that a controller can selectively meter the flow of liquid refrigerant through the liquid injection line for compressor capacity control and/or compressor discharge temperature control. Conventionally, this flow metering valve is an electronic expansion valve having a selectively variable flow area or a solenoid valve having a relatively small fixed area metering orifice, that is a fixed area orifice having a port diameter less than 2.0 millimeters.

SUMMARY OF THE INVENTION

A receiver is provided for collecting a refrigerant flowing through a refrigerant flow circuit. The housing defines an enclosed volume establishing a refrigerant collection reservoir, and has an inlet, a first outlet, and a second outlet. A refrigerant metering device is disposed within the enclosed volume in operative association with the second outlet for controlling a flow of refrigerant discharging through the second outlet. In an embodiment, the refrigerant metering device is capillary tube metering device. In an embodiment, the capillary tube metering device comprises a capillary tube formed into a multiple loop coil bounding an inner wall of the shell.

In an embodiment, the housing of the receiver includes a cylindrical shell having a first end cap closure and a second end cap closure collectively defining the enclosed volume. In an embodiment, the inlet port opens to the enclosed volume through the first end cap closure of the housing and the second outlet port opens through the housing at location remote from the first end cap closure.

The receiver may also include a filter/drier disposed within the enclosed volume at a location downstream of the inlet and upstream of both the first outlet and the second outlet. A refrigerant flow control valve may be mounted to the shell exteriorly of the enclosed volume in operative association with the first outlet. In an embodiment, the refrigerant flow control valve comprises a check valve.

A refrigerant vapor compression system includes a compression device, a condenser heat exchanger, an evaporator expansion device, and an evaporator heat exchanger arranged in a refrigerant flow circuit in serial refrigerant flow relationship in a refrigeration cycle; a receiver having a housing defining an enclosed volume establishing a refrigerant collection reservoir and having an inlet, a first outlet, and a second outlet, the first inlet in refrigerant flow communication with the condenser heat exchanger and the first outlet in refrigerant flow communication with the evaporator expansion device; a refrigerant metering device disposed within the enclosed volume of the housing in operative association with the second outlet for controlling a flow of refrigerant discharging through the second outlet; and a refrigerant injection line establishing refrigerant flow communication between the second outlet and the refrigerant flow circuit at a location upstream with respect to refrigerant flow of the compression device and downstream with respect to refrigerant flow of the evaporator heat exchanger. In an embodiment, the refrigerant metering device is capillary tube metering device.

The refrigerant vapor compression system may also include a refrigerant flow control valve disposed in the refrigerant injection line. In an embodiment, the flow control valve disposed in the refrigerant injection line comprises a fixed orifice flow control valve that may be selectively positioned in either an open position or a closed position. In an embodiment, the fixed orifice solenoid valve has a fixed orifice having a flow opening diameter of at least two millimeters.

BRIEF DESCRIPTION OF THE DRAWINGS

For a further understanding of the disclosure, reference will be made to the following detailed description which is to be read in connection with the accompanying drawing, wherein.

DETAILED DESCRIPTION OF THE INVENTION

Figure 1:
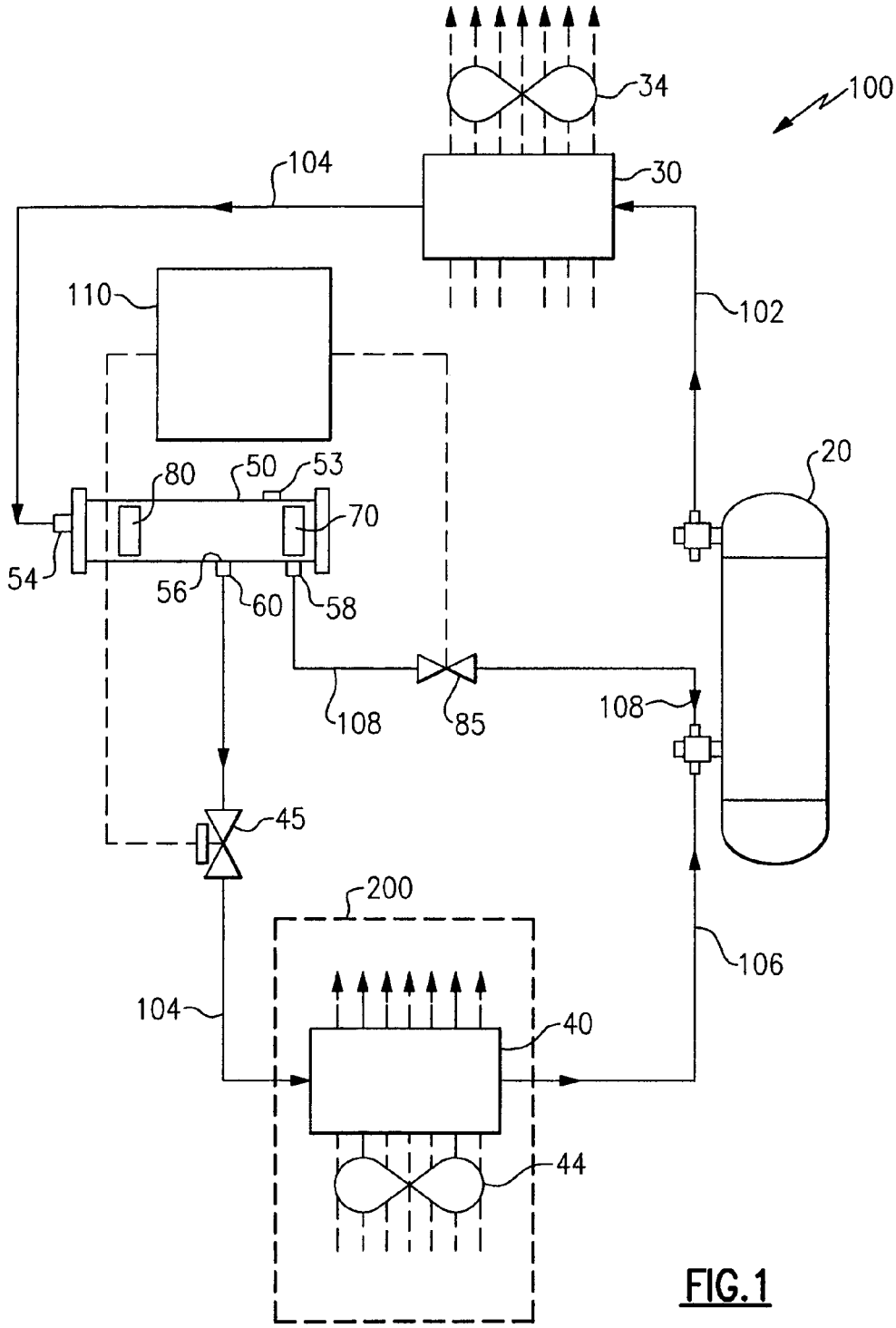
FIG. 1 is a schematic diagram of an exemplary embodiment of a refrigerant vapor compression system in accordance with the invention.

Referring initially to FIG. 1 of the drawing, there is depicted therein an exemplary embodiment of a refrigerant vapor compression system 100 that includes a compression device 20, a condenser heat exchanger 30, and an evaporator heat exchanger 40, connected in series refrigerant flow communication by refrigerant lines 102, 104 and 106, thereby connecting the aforementioned components in a primary refrigerant circuit in a refrigeration cycle. Refrigerant line 102 interconnects the refrigerant discharge outlet of the compression device 20 in refrigerant flow communication with the refrigerant inlet of the condenser heat exchanger 30. Refrigerant line 104 interconnects the refrigerant outlet of the condenser heat exchanger 30 in refrigerant flow communication with the refrigerant inlet of the evaporator heat exchanger 40. Refrigerant line 106 interconnects the refrigerant outlet of the evaporator heat exchanger 40 in refrigerant flow communication with the suction inlet of the compression device 20.

One or more condenser fan(s) 34 associated with the condenser heat exchanger 30 pass a fluid to be heated, typically ambient air, through the condenser heat exchanger 30 in heat exchange relationship with the refrigerant flowing through the condenser heat exchanger 30, whereby the refrigerant is cooled. One or more evaporator fan(s) 44 associated with the evaporator heat exchanger 40 pass air drawn from the climate controlled space 200 through the evaporator heat exchanger 40 in heat exchange relationship with the refrigerant flowing through the evaporator heat exchanger 40, whereby the refrigerant is evaporated and may also be superheated and the air is cooled and may also be dehumidified. The conditioned air having traversed the evaporator heat exchanger 40 is supplied back to the climate controlled space.

An evaporator expansion device 45, such as for example an electronic expansion valve or a thermostatic expansion valve, operatively associated with the evaporator 40, is disposed in refrigerant line 104 upstream with respect to refrigerant flow of the refrigerant inlet to the evaporator heat exchanger 40. A receiver 50 is disposed in refrigerant line 104 downstream with respect to refrigerant flow of the condenser heat exchanger 30 and upstream with respect to refrigerant flow of the evaporator expansion device 45. Additionally, a liquid refrigerant injection line 108 establishes refrigerant flow communication between the receiver 50 and the suction inlet of the compression device 20.

Figure 2:
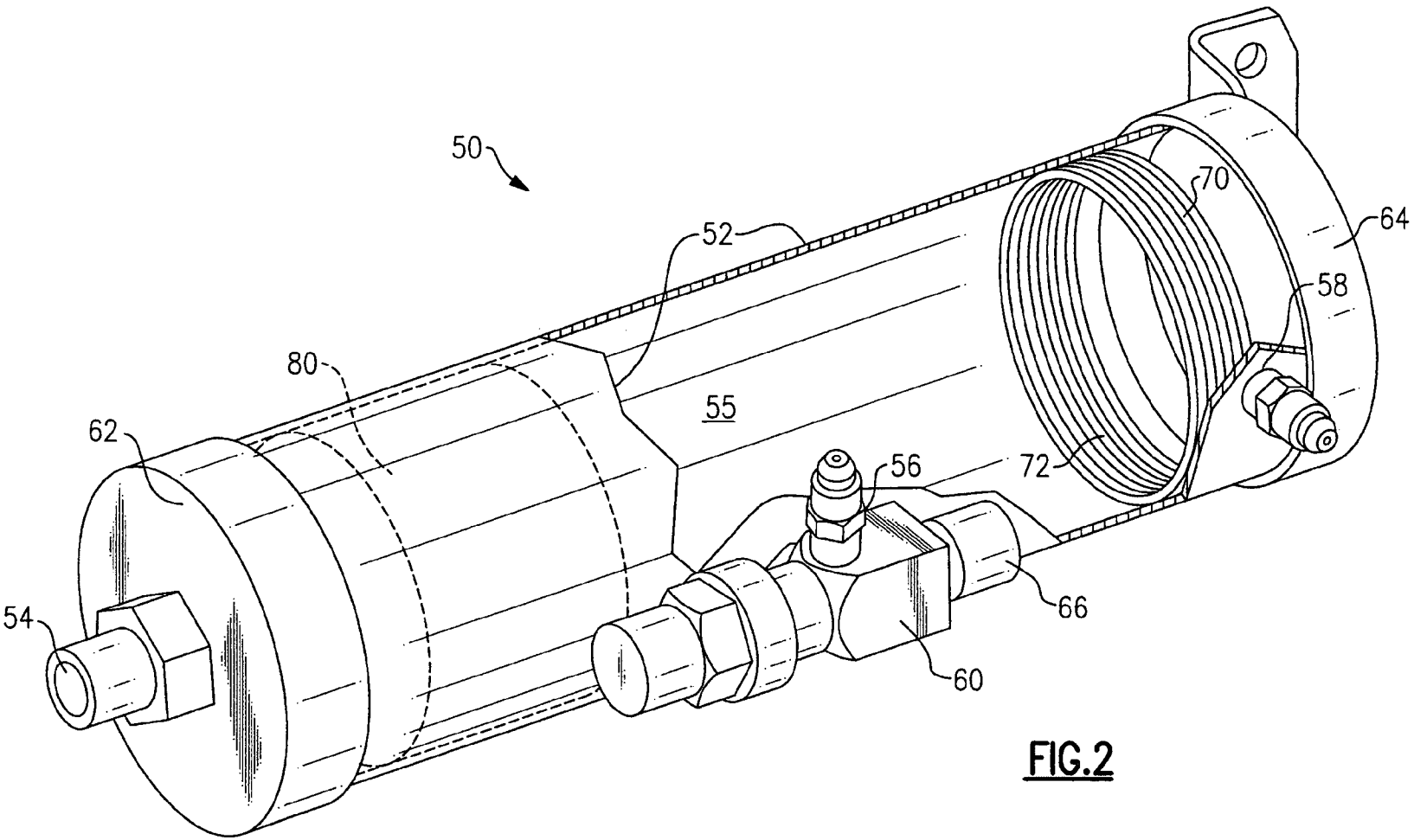
FIG. 2 is a perspective view, partly sectioned, of an exemplary embodiment of a receiver having a flow metering device integrated therein in accordance with the invention.

Referring now also to FIG. 2, the receiver 50 has a housing 52 that defines an enclosed volume 55 establishing a refrigerant collection reservoir for collecting refrigerant having traversed the condenser heat exchanger 30 and storing excess refrigerant. The housing 52 has a refrigerant inlet 54, a first liquid refrigerant outlet 56, and a second liquid refrigerant outlet 58. In the depicted embodiment, the housing 52 of the receiver 50 includes a cylindrical shell having a first end cap closure 62 and a second end cap closure 64 collectively defining the enclosed volume 55. In the depicted embodiment, the refrigerant inlet 54 opens to the enclosed volume 55 through the first end cap closure 62 of the housing 52. The second liquid refrigerant outlet 58 opens through the shell of the housing 52 at location remote from the first end cap closure 62. As depicted in FIG. 1, a sight glass 53 may be provided in operative association with the receiver 50 to permit viewing of the liquid level within the enclosed volume 55 of the receiver 50.

The first liquid refrigerant outlet 56 opens through the shell of the housing 52 at a location intermediate the refrigerant inlet 52 and the second liquid refrigerant outlet 58. A refrigerant flow control valve 60, depicted in FIG. 2 as a check valve, may be mounted to the shell exteriorly of the enclosed volume in operative association with the first outlet 56. The valve 60 has an outlet 66 that interiorly of the valve 60 is in flow communication with the first outlet 56. The inlet 54 of the receiver 50 is in refrigerant flow communication with the upstream leg of refrigerant line 104 and the outlet 66 of the valve 60, and therefore the first outlet 56, is in refrigerant flow communication with the downstream leg of the refrigerant line 104.

The receiver 50 may be installed in a horizontal orientation, as in the embodiment depicted in FIG. 2, or in a vertical orientation. In either the horizontal or vertical orientation, the first liquid refrigerant outlet 56 and the second liquid refrigerant outlet 58 are in refrigerant flow communication with a region of the enclosed volume 55 that is below the typical liquid level within the enclosed volume 55 of the receiver 50 under normal operating conditions.

A refrigerant flow metering device 70 is disposed within the enclosed volume 55 in operative association with the second liquid refrigerant outlet 58 for controlling a flow of refrigerant discharging through the second liquid refrigerant outlet 58. The refrigerant flow metering device 70 opens to a region of the enclosed volume 55 below the typical liquid level within the enclosed volume 55 of the receiver 50 under normal operating conditions to ensure that liquid refrigerant enters the refrigerant flow metering device 70. In the exemplary embodiment of the receiver 50 depicted in FIG. 2, the refrigerant flow metering device 70 comprises a capillary tube metering device 72, depicted as a capillary tube formed into a multiple loop coil bounding the inner surface of the shell of the housing 52. The capillary tube 72 is sized in diameter and length in a conventional manner to provide the desired flow metering characteristic. The capillary tube metering device 72 has an inlet 75 that opens to a region of the enclosed volume 55 below the typical liquid level within the enclosed volume 55 of the receiver 50 under normal operating conditions to ensure that liquid refrigerant enters the capillary tube metering device 72.

The refrigerant liquid injection line 108 establishes refrigerant flow communication between the second refrigerant outlet 58 and the suction inlet of the compression device 20. In the depicted embodiment, the refrigerant liquid injection line 108 taps back into the refrigerant flow circuit at a location in refrigerant line 106 downstream with respect to refrigerant flow of the evaporator heat exchanger 40 and the upstream with respect to refrigerant flow of the suction inlet of the compression device 20. Additionally, a flow control valve 85 is interdisposed in the refrigerant liquid injection line 108. Because the flow of refrigerant through refrigerant line 108 is metered by the metering device 70, the flow control valve 85 may simply be a two-position open/closed flow control valve, such as for example a two-position solenoid valve that is selectively positionable in either an open position whereat refrigerant may flow through refrigerant line 108 and a closed position whereat refrigerant flow through refrigerant line 108 is blocked. In typical prior art refrigerant vapor compression systems having a refrigerant liquid injection line connecting the receiver with the suction inlet of the compression device, a flow metering valve, such as an electronic expansion valve having a variable flow area metering orifice or a solenoid metering valve having a small, fixed area metering orifice, that is an orifice having a diameter less than two millimeters. Because the solenoid flow control valve 85 does not perform a metering function, the solenoid flow control valve 85 may have a relatively larger fixed orifice, that is a fixed area orifice having a diameter of at least two millimeters.

The refrigerant vapor compression system includes a controller 110 for controlling operation of the refrigerant vapor compression system 100 as in conventional practice. The controller may include a microprocessor and its associated memory, as well as an input/output interface with an associated analog-to-digital converter. As in conventional practice, the controller 110 may communicate with and/or manipulate various devices in the refrigerant vapor compression system 100, including without limitation: drives motors (not shown) operatively associated with the compressor 20, the condenser fan(s) 34 associated with the condenser heat exchanger 30, and the evaporator fan(s) 44 associated with the evaporator heat exchanger 40; and various system valves, such as the evaporator expansion device 45 if an electronic expansion valve. The controller 110 may also communicate with and receive input from various pressure sensors (not shown), for example pressure transducers, and temperature sensors (not shown), for example thermistors, thermocouples, thermostats or the like, such as a compressor discharge pressure transducer, a compressor suction pressure transducer, an evaporator pressure transducer, a compressor discharge temperature sensor, an evaporator outlet refrigerant temperature sensor, a box air temperature sensor, a humidity sensor, an ambient air sensor, and such other sensors as desired.

In operation, the controller 110 also controls whether or not refrigerant liquid is passed through the refrigerant liquid injection line 108 by either selectively positioning the solenoid flow control valve 85 in an open position or selectively positioning the solenoid flow control valve 85 in a closed position. However, the metering function, that is the determination as to the flow rate of the refrigerant flow passing through the refrigerant liquid injection line 108, is performed solely by means of the flow metering device 70 disposed within the enclosed volume 55 of the receiver 50 and in operative association with the second outlet 58 that opens to the inlet to the refrigerant liquid injection line 108.

The receiver 50 may also include a filter/drier 80 disposed within the enclosed volume 55 at a location downstream of the inlet 54 and upstream of both the first outlet 56 and the second outlet 58. So located, all refrigerant entering the enclosed volume 55 of the receiver 50 passes through the filter/dryer unit 80 whereby foreign matter, such as dirt, and moisture is removed from the refrigerant. The filter/dryer 80 may include a desiccant.

The terminology used herein is for the purpose of description, not limitation. Specific structural and functional details disclosed herein are not to be interpreted as limiting, but merely as basis for teaching one skilled in the art to employ the present invention. While the present invention has been particularly shown and described with reference to the exemplary embodiments as illustrated in the drawing, it will be recognized by those skilled in the art that various modifications may be made without departing from the spirit and scope of the invention. Those skilled in the art will also recognize the equivalents that may be substituted for elements described with reference to the exemplary embodiments disclosed herein without departing from the scope of the present invention.

Therefore, it is intended that the present disclosure not be limited to the particular embodiment(s) disclosed as, but that the disclosure will include all embodiments falling within the scope of the appended claims.

I claim:

1. A receiver for collecting a refrigerant flowing through a refrigerant flow circuit, comprising:

a housing defining an enclosed volume establishing a refrigerant collection reservoir, said housing having an inlet, a first outlet, and a second outlet;

a refrigerant metering device disposed within the enclosed volume in operative association with the second outlet for controlling a flow of refrigerant discharging through the second outlet; and a filter/drier disposed within the enclosed volume at a location downstream of the inlet and upstream of both the first outlet and the second outlet.

2. A receiver for collecting a refrigerant flowing through a refrigerant flow circuit, comprising:

a housing defining an enclosed volume establishing a refrigerant collection reservoir, said housing having an inlet, a first outlet, and a second outlet; and a refrigerant metering device disposed within the enclosed volume in operative association with the second outlet for controlling a flow of refrigerant discharging through the second outlet;

wherein the refrigerant metering device comprises a capillary tube metering device.

3. The receiver as recited in claim 2 wherein the capillary tube metering device comprises a capillary tube formed into a multiple loop coil bounding an inner wall of the shell.

4. A receiver for collecting a refrigerant flowing through a refrigerant flow circuit, comprising:

a housing defining an enclosed volume establishing a refrigerant collection reservoir, said housing having an inlet, a first outlet, and a second outlet;

a refrigerant metering device disposed within the enclosed volume in operative association with the second outlet for controlling a flow of refrigerant discharging through the second outlet; and a refrigerant flow control valve mounted to the shell exteriorly of the enclosed volume in operative association with the first outlet.

5. The receiver as recited in claim 4 wherein the refrigerant flow control valve comprises a check valve.

6. A receiver for collecting a refrigerant flowing through a refrigerant flow circuit, comprising:

a housing defining an enclosed volume establishing a refrigerant collection reservoir, said housing having an inlet, a first outlet, and a second outlet; and a refrigerant metering device disposed within the enclosed volume in operative association with the second outlet for controlling a flow of refrigerant discharging through the second outlet;

wherein the housing comprises a cylindrical shell having a first end cap closure and a second end cap closure collectively defining the enclosed volume.

7. The receiver as recited in claim 6 wherein the inlet port opens to the enclosed volume through the first end cap closure of the housing and the second outlet port opens through the shell at location remote from the first end cap closure.

8. A refrigerant vapor compression system comprising:

a compression device, a condenser heat exchanger, an evaporator expansion device, and an evaporator heat exchanger arranged in a refrigerant flow circuit in serial refrigerant flow relationship in a refrigeration cycle;

a receiver having a shell defining an enclosed volume establishing a refrigerant collection reservoir, said shell having an inlet, a first outlet, and a second outlet, the first inlet in refrigerant flow communication with the condenser heat exchanger and the first outlet in refrigerant flow communication with the evaporator expansion device;

a refrigerant metering device disposed within the enclosed volume of the shell in operative association with the second outlet for controlling a flow of refrigerant discharging through the second outlet; and a refrigerant injection line establishing refrigerant flow communication between the second outlet and the refrigerant flow circuit at a location upstream with respect to refrigerant flow of the compression device and downstream with respect to refrigerant flow of the evaporator heat exchanger.

9. The refrigerant vapor compression system as recited in claim 8 further comprising a refrigerant flow control valve disposed in the refrigerant injection line.

10. The refrigerant vapor compression system as recited in claim 9 wherein the flow control valve disposed in the refrigerant injection line comprises a fixed orifice flow control valve.

11. The refrigerant vapor compression system as recited in claim 10 wherein the fixed orifice solenoid valve has a fixed orifice having a flow opening diameter of at least two millimeters.

12. The refrigerant vapor compression system as recited in claim 8 further comprising a refrigerant flow control valve mounted to the shell exteriorly of the enclosed volume in operative association with the first outlet.

13. The refrigerant vapor compression system as recited in claim 12 wherein the refrigerant flow control valve comprises a check valve.

* * * * *